United States Patent [19]

Price

[11] 4,182,785

[45] Jan. 8, 1980

[54] PROCESS FOR IMPROVING RHEOLOGY OF CLAY SLURRIES

[75] Inventor: William M. Price, St. Austell, England

[73] Assignee: Anglo-American Clays Corporation, Sandersville, Ga.

[21] Appl. No.: 894,041

[22] Filed: Apr. 6, 1978

[51] Int. Cl.[2] ..... B44D 1/44; C04B 31/40

[52] U.S. Cl. ..... 427/361; 106/72; 106/288 B; 106/308 B; 106/308 Q; 106/308 M; 427/364

[58] Field of Search ..... 106/288 B, 72, 308 B, 106/306, 309; 423/328, 118, 324; 427/361, 364, 411

[56] References Cited

U.S. PATENT DOCUMENTS

| | | | |
|---|---|---|---|
| 2,251,256 | 7/1941 | Feldenheimer | 106/72 X |
| 2,255,371 | 9/1941 | Williams et al. | 106/72 |
| 2,920,832 | 1/1960 | Duke | 423/118 X |
| 3,085,894 | 4/1963 | Rowland | 106/288 B |
| 3,371,988 | 3/1968 | Maynard et al. | 106/72 X |
| 3,446,348 | 5/1969 | Sennett et al. | 106/72 X |
| 3,594,203 | 7/1971 | Sawyer et al. | 106/288 B |
| 3,738,938 | 6/1973 | Barrett | 106/308 B X |
| 3,850,655 | 11/1974 | Adams | 106/308 B |
| 3,884,964 | 5/1975 | Otrhalek et al. | 106/309 |
| 4,012,543 | 3/1977 | Ranger et al. | 427/361 |
| 4,018,673 | 4/1977 | Hughes et al. | 106/72 X |
| 4,088,732 | 5/1978 | Maynard et al. | 106/72 X |

*Primary Examiner*—Helen M. McCarthy

*Attorney, Agent, or Firm*—Weingram & Klauber

[57] ABSTRACT

In the process for producing a refined kaolin clay pigment by forming a crude kaolin clay into an aqueous slurry, performing a particle size classification, and subjecting the slurry to reductive bleaching with an alkali metal hydrosulfite; a method is disclosed for reducing the viscosity of a slurried product including the refined pigment, which method comprises adding a source of barium ion to the said bleached slurry, to thereby precipitate at least the sulfate ion present in that slurry from oxidation of the hydrosulfite ion during the bleaching step. The barium ion may be derived, e.g., from barium carbonate, which is added while the slurry preferably includes at least a 50% solids content by weight. The bleached slurry may be one which has been partially purified by an initial flotation, and which includes at least 99% by weight of particles less than 5 microns E.S.D., with substantially 100% by weight of the particles having an E.S.D. less than 10 microns. In this instance, the slurry may also include sulfate ion resulting from acidification of the float cell underflow with sulfuric acid prior to bleaching, as well as further sulfate ion resulting from the addition of alum prior to the filtering step which preferably pecedes the barium ion addition. The barium ion serves to precipitate the sulfate ion derived from all of these sources. The barium ion may also be added to a kaolin slurry as part of a high solids processing sequence, wherein a classification and a bleaching step are each conducted at a solids content between 60 and 75%, and at an alkaline pH.

15 Claims, No Drawings

PROCESS FOR IMPROVING RHEOLOGY OF CLAY SLURRIES

BACKGROUND OF INVENTION

This invention relates generally to kaolin clays, and more specifically relates to a process for improving the rheological properties of kaolin clay slurries to render same more suitable for paper coating applications.

Most crude kaolinitic clays contain impurities which impair the properties of the clay for paper coating purposes; and among the most important of these are iron-containing compounds which are dark colored and reduce the overall brightness or reflectance to visible light, of the clay. It is known that the effect of certain of these discoloring impurities may be reduced by treating the clay with a reducing agent which converts ferric compounds to the soluble, less highly colored ferrous form. The most widely used reducing agents for these purposes are the hydrosulfites, such as sodium hydrosulfite.

In addition to the foregoing ferruginous impurities, many crude kaolin clays, including the sedimentary kaolins common to Georgia, include iron-stained titanium-based impurities such as iron-stained anatase and rutile. These titaniferous compounds may be at least partially removed from crude kaolins containing same, by subjecting the slurried crude to a froth flotation treatment. In a typical such sequence, and as is well-known in the art, the crude kaolin is formed into an aqueous slurry, the pH of the slurry is raised to an alkaline value, for example by addition of ammonium hydroxide, and a collecting agent is added, as for example, oleic acid. The slurry is then conditioned by agitating same for a relatively sustained period. A frothing agent, such as pine oil is then added to the conditioned slurry, after which air is passed through the slurry in a froth flotation cell to effect separation with the froth of substantial quantities of the titaniferous discolorants.

The classified underflow from the flotation cell is then commonly acidified, usually with sulfuric acid to a pH of about 3.0 to 5.0—as a prelude to the reductive bleaching step. The latter is then carried out using a hydrosulfite, such as the aforementioned sodium hydrosulfite.

At this point in the above conventional process, the slurry includes from about 15 to 30% solids, and prior to being subjected to a filtering step, alum may be added as a filtration aid. The filtration, e.g., by rotary vacuum filters dewaters the slurry to about 52 to 58% solids, after which the pH of the slurry is adjusted to about 7.0 with sodium hydroxide, and various dispersants are added to the slurry. The slurry can then be spray-dried and later reconstituted for use; or the slurry can be mixed with dried material to form a 70% solids slurry product—suitable, e.g., for shipping.

The various processing steps described above, unfortunately tend to introduce a variety of chemicals which can remain with the refined kaolin pigment and impair same in a number of respects, including by adversely affecting the rheological characteristics of the slurried kaolin products including the refined pigment. More specifically the large quantities of soluble sulfates introduced by oxidation of the hydrosulfites during bleaching, from the sulfuric acid added prior to bleaching, and from the alum, tends to increase the viscosity in slurried and dispersed kaolin products including the refined pigments. Thus, it may be found that a slurried kaolin product including such refined pigments, and intended for use in paper coating application, can display an undesirable "high-shear viscosity," where the quoted term refers to the coating clay characteristic defined in TAPPI Method T 648 su-72 (Rev. 1972).

It may further be noted that in the copending application of David G. Bell et al, Ser. No. 764,380, filed Jan. 31, 1977, now abandoned, a method is disclosed wherein refining of a kaolin crude is carried out while maintaining throughout a high solids content—i.e., usually between 60 and 75% solids by weight. No flotation step is used; rather a classification and a reductive bleaching step are sequentially conducted—all operations can be conducted at an alkaline pH to avoid flocculation, and no intermediate dewatering steps are used. In this high solids sequence, sulfate ion nonetheless is inevitably introduced via the reductive bleaching step, with consequent generation of viscosity problems in the refined product.

SUMMARY OF INVENTION

Now in accordance with the present invention, it has been discovered that the viscosity characteristics yielded from a kaolin clay pigment which has previously been refined by forming a crude kaolin clay into an aqueous slurry, performing a particle size classification, and subjecting the slurry to reductive bleaching, e.g., with sodium hydrosulfite, may be markedly improved by addition of a source of barium ion to the bleached slurry during such refining process. The barium ion thereby precipitates at least the sulfate ion present in the slurry in consequence of oxidation of the hydrosulfite ion during the bleaching step. The barium ion may be derived e.g. from a slurry-soluble barium salt, such as barium carbonate, which is preferably added in concentrations of from about 1 to 9 lb/ton of dry clay, and at a point in the slurry processing sequence such that the slurry includes at least 50% by weight solids. As the insoluble barium sulfate itself is very white, the said composition may remain in suspension in slurried kaolin products including the refined pigment without any detrimental brightness effects when such products are used for coating applications.

It is to be understood that the term "viscosity" as used herein with respect to clay slurries, refers to such characteristics as determined pursuant to the procedures set forth in TAPPI Method T 648 su-72, as revised in 1972. This method describes a procedure for the determinations of the low and high shear viscosity of coating clays.

The bleached slurry may be one which has been partially purified by an initial froth flotation treatment as previously described, in which instance the slurried clay has been classified to about 99% by weight of particles having an E.S.D. (equivalent spherical diameter) of less than 5 microns, with substantially 100% by weight of the particles having an E.S.D. less than 10 microns. The slurry in this instance will include an addition to sulfate ion resulting from oxidation of hydrosulfites, sulfate ion resulting from acidification of the float cell underflow with sulfuric acid prior to the bleaching step; further sulfate ion may be present from addition of alum (aluminum sulfate) prior to a filtering step which follows the bleaching. In any event the barium ion is preferably added subsequent to the said filtering step, and acts to precipitate the sulfate ion deriving from all of the mentioned sources following addition of the barium ion, the pH of the slurry may be adjusted by addition of sodium hydroxide to approximately 7.0.

The barium ion may also be added to a kaolin slurry as part of the previously discussed high solids processing sequence. In this instance the kaolin clay slurry is initially formed and subjected to a particle size classification, e.g. in a centrifuge, before being subjected to reductive bleaching. Following such bleaching the barium ion may be added as aforesaid—in order to neutralize the effects of the sulfate ion resulting from oxidation of the hydrosulfite. In this high solids process all of the aforementioned steps are conducted while maintaining a solids content in the slurry of between 60 and 75%, and all steps may be carried out while maintaining an alkaline pH.

The barium ion, pursuant to a further aspect of the invention, is preferably added to the slurry in the presence of dispersants, to achieve in combination therewith a minimum viscosity in the thereby treated slurry.

Suitable dispersants may be, for example, a water-soluble salt of a condensed phosphate such as a pyrophosphate, hexametametaphosphate, or tripolyphosphate, or a water-soluble salt of a polysilicic acid, for example sodium silicate, or a water-soluble organic polymeric dispersing agent, for example a polyacrylate or a polymethacrylate having a number average molecular weight in the range from about 500 to about 10,000, or a copolymer of the type described in British Patent Specification No. 1,414,964, or may be a mixture of two or more of the foregoing materials. The total amount of dispersants used will generally lie in the range of from 0.05 to 0.4% by weight based on the weight of dry clay.

A particularly advantageous dispersant composition is a mixture of a water-soluble condensed phosphate with an organic polymeric dispersing agent, for example one of the polyacrylate, polymethacrylate or copolymeric type described above.

DESCRIPTION OF PREFERRED EMBODIMENT

The invention is further illustrated by the following Examples:

EXAMPLE I

In order to demonstrate the advantages of the invention, a series of samples were taken from a plant processing stream normally utilized in effecting purification of kaolins by flotation and bleaching techniques. In this plant process the clays treated were sedimentary soft Georgia kaolins.

In the procedure utilized the crude clay was blunged and conditioned by forming an aqueous alkaline dispersion of the clay, the pH being adjusted to about 7 to 10 with ammonium hydroxide. The dispersion included as a deflocculating agent sodium silicate in the range of from about ½ to 16 lbs. per ton. The clay slurry, during the blunging and conditioning operations included about 60% solids, and the conditioning process was continued for sufficient time to dissipate at least 25 hp-hr of energy per ton of solids. The blunged and conditioned slurry after addition of pine oil as a frothing agent, was then subjected to a conventional treatment in a froth flotation cell, i.e. air was passed through the slurry in said cell to effect separation of impurities from the clay.

Pursuant to normal plant practice the purified underflow from the flotation cell is adjusted to a pH of about 3.0 to 4.0 with sulfuric acid, and then reductive bleached with sodium hydrosulfite at addition levels of 4 to 9 lbs/ton. Thereafter alum is added in quantities of 1 to 4 lbs/ton as a filtration aid—and the slurry (which at this point includes 20 to 25% solids) is thickened via rotary vacuum filters to about 52–58% solids. The refined slurry can be spray-dried, or marketed as a 70% solids slurry.

In this Example a sample was taken from the plant processing line immediately after filtration. The flocculated filter cake was dispersed, treated with barium carbonate, and dried in the laboratory. The viscosities of the various samples were then determined.

Results yielded by the foregoing procedures with various addition levels of barium carbonate to a typical 95% less than 2 microns (by weight) paper coating pigment, are given in Table I. All viscosities are minimum viscosities of fully deflocculated slips, measured using Brookfield and Hercules Viscometers.

TABLE I

| $BaCO_3$ lbs/ton of dry clay | Viscosity Data: Brookfield at 20 rpms in cps | Viscosity Data: High Shear Dyne-cm × $10^5$ | Dispersant Dose in lbs/ton dry clay: Dispex* | Dispersant Dose in lbs/ton dry clay: TSPP** |
|---|---|---|---|---|
| 0 | 1400 | 18 at 1015 rpm | 1.5 | 3.0 |
| 0.5 | 620 | 18 at 985 rpm | 1.5 | 2.5 |
| 1.0 | 500 | 5 at 1100 rpm | 1.5 | 2.5 |
| 2.0 | 380 | 6 at 1100 rpm | 1.5 | 2.0 |
| 3.0 | 320 | 3.3 at 1100 rpm | 1.5 | 2.0 |
| 4.0 | 280 | 3.2 at 1100 rpm | 1.5 | 1.5 |
| 5.0 | 260 | 3.2 at 1100 rpm | 1.5 | 1.5 |

*Trademark of Allied Colloids, Great Britain, for a water soluble salt of a polyacrylic or a polymethacrylic acid.
**Tetrasodium pyrophosphate In accordance with a further aspect of the present invention, it has been found that the invention enables highly significant and unexpected improvements in the gloss properties of papers coated with compositions including clays which have been treated by the process of the invention. This is illustrated by the following two examples:

EXAMPLE II

As described in EXAMPLE I, samples were taken from the plant processing line immediately after filtration. The flocculated filter cake was dispersed, treated with barium carbonate at various doseages, and dried. The resulting samples were then incorporated into a paper coating composition consisting (by weight) of 100 parts of the clay, 7 parts starch, and 7 parts styrene butadiene latex, the composition being applied with a moisture content of 36%. This composition was applied to a precoated merchant grade base paper produced by the Northwest Paper Co., by means of a HELI-COATER (trademark of English China Clays Co., Ltd.) pilot scale trailing blade coater. The resulting coated paper was calendered at 3 nips at 250 lbs. per linear inch pressure at 150° F., and then tested for gloss using a Hunter 75° gloss meter. Results are given in Table II below, which also includes viscosity measurements for the various clay samples, such measurements being effected by the TAPPI Method T648 su-72 previously referenced. The coat weight in all instances is 10 g/m²:

TABLE II

| $BaCO_3$ in wt. % based on dry clay | Viscosity Data: Brookfield in cp at 20 rpm | Viscosity Data: High Shear in Dyne-cm × $10^5$ | Gloss of Coated Paper |
|---|---|---|---|
| 0 | 1400 | 18 at 1015 rpm | 64.4 |
| 0.05 | 620 | 18 at 985 rpm | 66.5 |
| 0.1 | 500 | 5 at 1100 rpm | 66.2 |
| 0.15 | 380 | 6 at 1100 rpm | 67.5 |
| 0.2 | 320 | 3.3 at 1100 rpm | 68.9 |
| 0.25 | 280 | 3.2 at 1100 rpm | 71.7 |

EXAMPLE III

The procedures of Example II were repeated using doseage levels of 0 and 0.25% by weight barium carbonate, with the resultant clay samples being incorporated into the same paper coating composition. The said composition was then applied as before to the Northwest base paper by means of the HELICOATER, and the resulting coated paper was calendered at 5 nips at 167 lbs per linear inch and 150° F.

The clay sample with 0% barium carbonate was found to have a Brookfield viscosity of 630 cps at 20 rpm, and a high shear viscosity of 18 dyne-cm$\times 10^5$ at 810 rpm, using the aforementioned TAPPI Method. The coated paper gloss at 12 g/m$^2$ coat weight, was 71.

The clay sample with 0.25% barium carbonate addition was found to have a Brookfield viscosity of 310 cps at 20 rpm, and a high shear viscosity of 2.5 dyne-cm$\times 10^5$ at 1100 rpm. The coated paper gloss in this instance (at 12 g/m$^2$ coat weight) had markedly increased to 75.

The following Examples illustrate practice of the invention in connection with high solids processing of kaolin clays:

EXAMPLE IV

A raw kaolin clay from Warren County, Ga., was mixed with water containing dispersing agents to form a suspension containing 69% by weight of dry kaolin. The dispersing agents were tetrasodium pyrophosphate and a sodium polyacrylate having a number average molecular weight of 1650, and they were used in the proportions 5 parts by weight of tetrasodium pyrophosphate to 1 part by weight of sodium polyacrylate. The total amount of dispersing agents used was 0.4% by weight of the combined dispersing agents based on the weight of dry kaolin. The pH was corrected to 9.0 with sodium hydroxide and the raw clay was dispersed in the water in a mixer which comprised a cylindrical vessel of diameter 450 mm and depth 450 mm and an impeller consisting of a single round bar of length 75 mm and diameter 9.5 mm which was rotated at a speed of 2850 r.p.m. by means of a 1 H.P. electric motor.

The dispersed aqueous suspension of kaolin was passed through a No. 100 mesh B.S. sieve (nominal aperture 150 microns) to remove the coarsest particles and the sieved suspension was treated in a scroll-type centrifuge in which the coarser particles were sedimented leaving a suspension which had a particle size distribution such that 0.01% by weight consisted of particles having a diameter larger than 50 microns, 3% by weight consisted of particles having an equivalent spherical diameter larger than 10 microns, and 83% by weight consisted of particles having an equivalent spherical diameter smaller than 2 microns. This suspension was divided into a number of portions.

Portions of the suspension of kaolin prepared as described above and having a solids content of 69% by weight and a pH of 8.5 were bleached with 8 lb of sodium hydrosulfite per ton of dry kaolin by addition of a 12.5% w/w solution of sodium hydrosulfite which was added while the kaolin was stirred sufficiently vigorously to form a vortex, and then when all the sodium hydrosulfite had been added, the speed of the stirrer was reduced until the vortex just collapsed and stirring was continued at this speed for 30 minutes. After each portion had been treated with sodium hydrosulfite and stirred for 30 minutes after the addition of sodium hydrosulfite was complete, 8 lb of calcium orthophosphate per ton of dry kaolin was added to each portion which was stirred for a further 15 minutes, and there were then added to the portions 0, 2, 4, and 6 lb respectively of barium carbonate per ton of dry kaolin, and each portion was stirred for a final period of 15 minutes. The percentage by weight of solids in a fully deflocculated aqueous suspension having a viscosity of 5 poise at 22° C. was then determined for each portion using a Brookfield Viscometer with No. 3 spindle at 100 r.p.m.

The results obtained are set forth in Table III below:

TABLE III

| Amount of barium carbonate added (Lb/Ton) | Wt. % solids of slurry having a viscosity of 5 poise, measured at 100 rpm using a Brookfield Viscometer |
|---|---|
| 0 | 70.4 |
| 2 | 70.5 |
| 4 | 70.7 |
| 6 | 71.9 |

These results show that the addition of barium carbonate yields an improvement in the rheological properties of an aqueous suspension of the kaolin.

EXAMPLE V

Three further portions of the suspension of kaolin prepared as described in Example IV were treated in the following ways. The first portion, without further treatment, was incorporated into a paper coating composition, coated onto a base paper and the brightness of the coated paper was measured. The second portion was bleached by the method described in Example IV, using 8 lbs of sodium hydrosulfite per ton of dry kaolin. The third portion was bleached by the method described in Example IV, using 8 lbs of sodium hydrosulfite per ton of dry kaolin, except that, after suspension had been treated with the sodium hydrosulfite and stirred for 30 minutes after the addition of sodium hydrosulfite was complete, 10 lbs of calcium orthophosphate per ton of dry kaolin was added and the suspension was then stirred for a further 15 minutes. 4 lbs of barium carbonate per ton of dry kaolin was then added and the suspension was stirred for final period of 15 minutes. The second and third portions were then incorporated into paper coating compositions and coated onto base paper in the same manner as the first portion.

Before each suspension was incorporated into the paper coating compositions, each was tested for the percentage by weight of solids in a fully deflocculated aqueous suspension having a viscosity of 5 poise at 22° C. using a Brookfield Viscometer with No. 3 spindle at 100 r.p.m.

Each paper coating composition was prepared to the following formulation:

| Ingredient | Parts by weight |
|---|---|
| Dry clay | 100 |
| Oxidized starch | 14 |
| Calcium stearate | 0.5 |
| Water to about 60% by weight of total solids | |
| Sodium hydroxide to give a pH of 9–10 | |

Each coating composition was coated onto a sheet of offset base paper of weight 61 grams per square meter using a laboratory trailing blade paper coating machine at a paper speed of 500 meters per minute. Samples of coated paper were prepared having coat weights in the range from 8 to 16 grams per square meter. Each sample was conditioned at 50% Relative Humidity and 23° C. for 16 hours, calendered at 500 psi and 65° C. for 10 passes and conditioned again before measurement. Each sample was tested for reflectance to light of wavelength 458 Å and 574 Å and the value for a coat weight of 12 grams per square meter was found by interpolation.

The viscosity and total solid content of each paper coating composition were also measured. The results are set forth in Table IV below:

TABLE IV

| Treatment | 5 poise viscosity concentration at 22° C.(% by wt solids) | Paper coating composition Visc: (cp) | Paper coating composition % by wt. solids | Coated paper reflectance to light of wavelength 458 Å | Coated paper reflectance to light of wavelength 574 Å |
|---|---|---|---|---|---|
| Unbleached | 72.9 | 2280 | 61.4 | 72.1 | 82.7 |
| Hydrosulfite only | 67.3 | 5200 | 59.7 | 74.2 | 82.9 |
| Hydrosulfite + barium carbonate | 72.2 | 4600 | 61.6 | 74.2 | 83.4 |

These results show that the portion bleached with sodium hydrosulfite alone confers a higher viscosity to an aqueous suspension. The addition of barium carbonate, however, restores the rheological properties of the bleached clay. The beneficial affect of the barium ion addition on the resulting paper gloss, is equally evident.

It will be evident that salts of barium in addition to barium carbonate, which have good solubility in the kaolin slurry, may be used in the present invention—such as barium chloride. Similarly other slurry-soluble sources of barium ion, such as barium hydroxide may be utilized.

It may further be noted that sources of other alkaline metal ions, such as alkaline metal carbonates other than barium carbonate, are unsatisfactory for use in the process of the present invention. More specifically it has been found that the sulfate ion concentration initially present in the slurries treated by the invention, are such that any metal ion the sulfate of which has a solubility of about 0.2 g/100 g of water at 25° C. or greater, would not precipitate any of the said sulfate present in the clay slurry. Sulfates are thus typically present in the clay slurries treated by the invention, in concentrations such that no lithium sulfate, sodium sulfate, calcium sulfate, or magnesium sulfate, could precipitate; and strontium sulfate would precipitate to an inadequate degree to effect the improvements yielded by the invention.

While the present invention has been particularly set forth in terms of specific embodiments thereof, it will be understood in view of the instant disclosure, that numerous variations upon the invention are now enabled to those skilled in the art, which variations yet reside within the scope of the present teaching. Accordingly the invention is to be broadly construed, and limited only by the scope and spirit of the claims now appended hereto.

I claim:

1. In the process for producing a refined kaolin clay pigment by forming a crude kaolin clay into an aqueous slurry, and reductive bleaching the slurry with an alkali metal hydrosulfite to solubilize and chemically reduce iron-containing discolorants in the crude clay and thereby improve the brightness of said clay; a method enabling reduction of viscosity in a slurried product including said pigment, comprising:

adding to said bleached slurry at a solids content of at least 50% by weight, a source of barium ion, to thereby precipitate at least the sulfate ion present in said slurry in consequence of oxidation of the hydrosulfite ion during said bleaching step; said processing of said crude kaolin through said bleaching step being effected at low solids content, said at least 50% solids content being thereafter achieved by filtration; and said barium ion being added to said slurry in the presence of dispersants, to achieve in combination therewith a minimum viscosity in the thereby treated slurry.

2. A method in accordance with claim 1, wherein said slurry has been classified so that at least 99% by weight of the clay particles are of less than 5 microns E.S.D., and substantially all of said particles are of less than 10 microns E.S.D.

3. A method in accordance with claim 1, wherein said slurry is acidified prior to filtration with a source of sulfate ion; said barium ion further precipitating said sulfate ion in said slurry deriving from said acid source.

4. A method in accordance with claim 3, wherein said slurry is subjected to a froth flotation to remove titaniferous discolorants prior to said reductive bleaching step, and wherein said acid source is sulfuric acid which is added to said slurry following flotation to reduce the pH to 4.0 or below.

5. A method in accordance with claim 4, wherein said slurry is bleached with sodium hydrosulfite, and wherein alum is added as a filtration aid; said barium ion acting further to precipitate sulfate ion derived from said alum.

6. A method in accordance with claim 5, wherein said filtering is effected with rotary vacuum filters.

7. A method in accordance with claim 3, wherein following addition of said barium ion to precipitate said sulfate ion, the pH of said slurry is adjusted by addition of sodium hydroxide to approximately 7.0.

8. A method in accordance with claim 3, wherein said barium ion is added to said slurry in combination with organic and inorganic dispersants.

9. A method in accordance with claim 8, wherein said dispersants include a mixture of a water soluble salt of a condensed phosphate together with an organic polymeric dispersing agent.